US009909771B2

(12) United States Patent
Wolgamott et al.

(10) Patent No.: US 9,909,771 B2
(45) Date of Patent: Mar. 6, 2018

(54) MASS AIRFLOW MEASURING SYSTEM FOR A BUILDING HAVING A SENSOR ASSEMBLY MOUNTED TO AN INTERIOR WALL OF AN AIR CONDUIT

(71) Applicants: Nikolas James Wolgamott, Grand Ledge, MI (US); Kevin P. Hein, Dimondale, MI (US); Robert J. Pierce, III, Eaton Rapids, MI (US)

(72) Inventors: Nikolas James Wolgamott, Grand Ledge, MI (US); Kevin P. Hein, Dimondale, MI (US); Robert J. Pierce, III, Eaton Rapids, MI (US)

(73) Assignee: NJK Precision LLC, Eaton Rapids, MI (US)

( * ) Notice: Subject to any disclaimer, the term of this patent is extended or adjusted under 35 U.S.C. 154(b) by 22 days.

(21) Appl. No.: 15/229,830

(22) Filed: Aug. 5, 2016

(65) Prior Publication Data

US 2017/0045386 A1 Feb. 16, 2017

Related U.S. Application Data

(60) Provisional application No. 62/203,189, filed on Aug. 10, 2015.

(51) Int. Cl.
*F24F 11/00* (2006.01)
*F24F 11/04* (2006.01)

(52) U.S. Cl.
CPC ..... *F24F 11/001* (2013.01); *F24F 11/04* (2013.01); *F24F 2011/0038* (2013.01)

(58) Field of Classification Search
None
See application file for complete search history.

(56) References Cited

U.S. PATENT DOCUMENTS 6,467,359 B1 10/2002 Atwood
6,487,918 B1 * 12/2002 DeAngelis ..... G01F 1/46 73/861.66
6,715,367 B1 4/2004 Gonzales et al.
6,871,534 B1 * 3/2005 Hamada ..... F02D 41/185 73/202.5
2006/0230825 A1 * 10/2006 Gryc ..... G01F 1/46 73/204.22
2017/0045389 A1 * 2/2017 Wolgamott ..... F24F 11/001

* cited by examiner

*Primary Examiner* — Harshad R Patel
(74) *Attorney, Agent, or Firm* — Fay Sharpe LLP

(57) ABSTRACT

A mass airflow measuring system includes an air conduit and a sensor assembly mounted to the air conduit, including a unitary one-piece first section which in cross section defines a first channel, a second channel and a wall separating the two channels. A second section has similar components. A unitary one-piece corner section, in cross section includes four legs, each defining a respective channel. A respective leg is mounted in a respective one of the channels of the first and second sections to communicate the sections with each other through the channels defined in the corner section legs. A sensor housing is mounted to one of the sections and includes an inlet opening communicating with the first channel and an exit opening communicating with the second channel. A mass airflow sensor communicates with a sample channel defined in the housing.

21 Claims, 7 Drawing Sheets

MASS AIRFLOW MEASURING SYSTEM FOR A BUILDING HAVING A SENSOR ASSEMBLY MOUNTED TO AN INTERIOR WALL OF AN AIR CONDUIT

This application claims the benefit of Provisional Application Ser. No. 62/203,189 which was filed on Aug. 10, 2015. The entire content of that application is incorporated hereinto by reference.

BACKGROUND

The present disclosure is directed to airflow measuring devices. More particularly, it is directed to a system and a method for measuring airflow in a building.

Controlling airflow in a building in regard to both volume and temperature is important for the comfort and wellbeing of the occupants of the building. Heating and cooling a building necessarily involves significant energy costs. Present techniques for monitoring and/or controlling airflow in a building employ airflow measuring devices having limitations on their accuracy. These can impact the comfort of the building occupants, as well as the costs for heating and cooling the building.

It would be desirable to provide a mass airflow measuring system, including a sensor assembly which is adapted to be placed in an air passageway, which system is more accurate than what is currently available. It would also be desirable to provide a mass airflow measuring system with components which are easily extruded and molded so as to create an inexpensive mass airflow measuring system.

SUMMARY

In one embodiment, a mass airflow measuring system includes a sensor assembly adapted to be placed in an air conduit. The sensor assembly comprises a rectangular structure wherein a cross-section of one leg of the structure includes a pair of parallel, longitudinally extending channels separated by a wall. The first channel includes a first opening communicating with the main air passageway, to allow air flowing through the main air passageway to enter the first channel. The second channel is located downstream from the first channel and includes a second opening which communicates with the main air passageway to allow air to exit the second channel. A sample channel leads from the first channel to the second channel permitting air to flow from the first channel towards the second channel. A mass airflow sensor communicates within the sample channel to receive airflow. The sensor is operative to output an airflow signal based on the airflow received by the mass airflow sensor. A processing unit receives the airflow signal from the mass airflow sensor and is operative to process the airflow signal and output a processed airflow signal.

According to an embodiment of the present disclosure, a mass airflow measuring system comprises an air conduit and a sensor assembly mounted to the air conduit. The sensor assembly includes a unitary one-piece first section which comprises in cross-section a first channel, a second channel and a wall separating the first channel from the second channel. A unitary one-piece second section comprises in cross-section a first channel, a second channel and a wall separating the first channel from the second channel. A unitary one-piece corner member comprises a first leg that defines a first channel, a second leg that defines a second channel, as well as third and fourth legs in which are defined respective first and second channels. The first leg first channel and second leg second channel communicate with a respective one of the first section first channel and second channel. The third leg channel and fourth leg second channel communicate with a respective one of the second section first channel and second channel. The corner section first leg and third leg extend at one of an acute angle, a right angle and an obtuse angle in relation to each other. A sample housing is mounted to one of the first and second sections wherein the sample housing includes an inlet opening communicating with the first channel of the one of the first and second sections, an exit opening communicating with the second channel of the one of the first and second sections and a sample channel communicating the inlet opening with the exit opening. A mass airflow sensor communicates with the sample channel to receive airflow, wherein the mass airflow sensor outputs a signal based on the airflow received by the mass airflow sensor.

According to another embodiment of the present disclosure, a mass airflow measuring system comprises a rectangular air conduit and a sensor assembly mounted to the air conduit. The sensor assembly includes a one-piece first section which comprises in cross section a first channel, a second channel and a wall separating the first channel from the second channel and a one-piece second section which comprises in cross section a first channel, a second channel and a wall separating the first channel from the second channel. A one-piece corner section includes a first leg defining a first channel portion, the first leg being adapted to slide into the first section first channel. Spaced therefrom is a second leg defining a second channel portion, the second leg being adapted to slide into the first section second channel. A third leg of the corner section defines a first channel portion, the third leg being adapted to slide into the second section first channel portion and spaced therefrom is a fourth leg defining a second channel portion, the fourth leg being adapted to slide into the second section second channel, wherein the first and second legs protrude from a base of the corner section. A sample housing is mounted to one of the first and second sections. The sample housing includes an inlet opening communicating with the first channel of the one of the first and second sections, an exit opening communicating with the second channel of the one of the first and second sections and a sample channel communicating the inlet opening with the exit opening. A mass airflow sensor is held in the housing so as to receive airflow from the sample channel.

In one embodiment, the mass airflow measuring assembly includes four venturi leg sections, which can be assembled into a rectangular arrangement by being connected to respective ones of four corner sections. Each venturi leg section or member can comprise a housing which is divided into two spaced channels or chambers. The first channel is open via a first slot to air flowing in the building duct work past the sensor assembly. The second channel communicates via a second slot with the air flowing through the duct work at a downstream location. A sample channel located in a sensor housing allows the two channels in the venturi section to communicate with each other. Provided in the sensor housing and communicating with the sample channel is a sensor.

In accordance with yet another embodiment of the present disclosure, a mass airflow measuring system comprises a rectangular air conduit and a rectangular sensor assembly mounted to an interior wall of the air conduit. The assembly comprises first, second, third and fourth sections, each including a planar rear wall and an airfoil-shaped front wall and each defining a first channel, a second channel and a wall separating the first channel from the second channel. First, second, third and fourth corner sections each include a first leg defining a first channel and spaced therefrom, a second leg defining a second channel. The corner sections also include a third leg which defines a first channel and spaced therefrom a fourth leg which defines a second channel. The first channels of the first conduits of the first, second, third and fourth sections communicate with each other via the first channels of the first, second, third and fourth corner sections. The second channels of the first, second, third and fourth sections communicate with each other via the second channels of the first, second, third and fourth corner sections. A sample housing is mounted to one of the first, second, third and fourth sections. The sample housing includes an inlet opening communicating with the first channel of at least one of the first, second, third and fourth sections and an outlet opening communicating with the second channel of at least one of the first, second, third and fourth sections. A sample channel communicates the housing inlet opening with the housing exit opening. A mass airflow sensor is held in the housing so as to receive airflow from the sample channel.

Methods of measuring airflow utilizing the mass airflow sensor assembly may be employed for controlling airflow within a building. Utilizing accurate airflow and temperature signals supplied to a heating ventilation and air conditioning (HVAC) system of a building provides operational real time precise measurement of air volume. This enables controlled temperature adjusted airflow to various zones within the building while maintaining required ventilation and providing significant energy savings.

Joining a mass airflow measuring device with a variable air volume box and a processing unit provides processed airflow and temperature signals to a controller, such as a direct digital control system of a building's HVAC system.

BRIEF DESCRIPTION OF THE DRAWINGS

The disclosure may take form in certain structures and components, several embodiments of which will be described in detail in this specification and illustrated in the accompanying drawings wherein.

DETAILED DESCRIPTION

Figure 1:
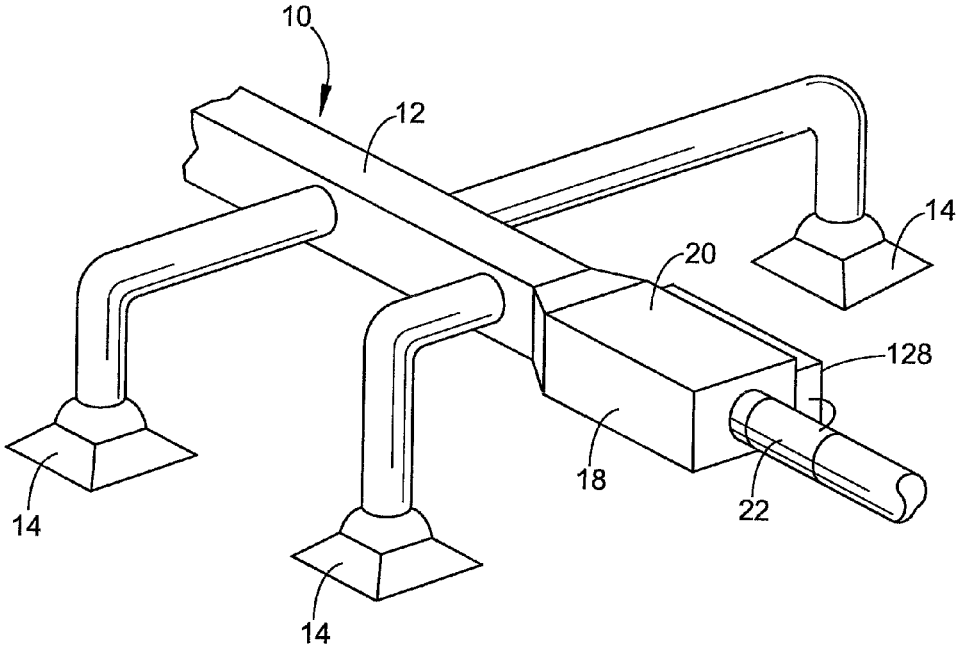
FIG. 1 is schematic view of an HVAC system, such as for a building, with a variable air volume box to which is connected a mass airflow measuring system according to one embodiment of the present disclosure.

With reference to FIG. 1, a mass airflow measuring system according to the present disclosure can be employed in a building provided with a heating, ventilating and air conditioning (HVAC) system. In one embodiment, such a building includes a building duct work system 10 comprising a central duct 12 and a plurality of air outflow ducts 14 which can, for example, lead to separate rooms in the building. Communicating with the central duct 12 is a variable air volume terminal unit 18 which can take the form of a box 20. Leading to the box 20 is an inlet duct 22. Both the inlet duct 22 and the central duct 12, as well as the various air outflow ducts 14, can in cross-section be round, rectangular, elliptical or assume any other conventional cross-sectional shape. Generally, however, at least the larger ducts are rectangular in cross-section.

Figure 2:
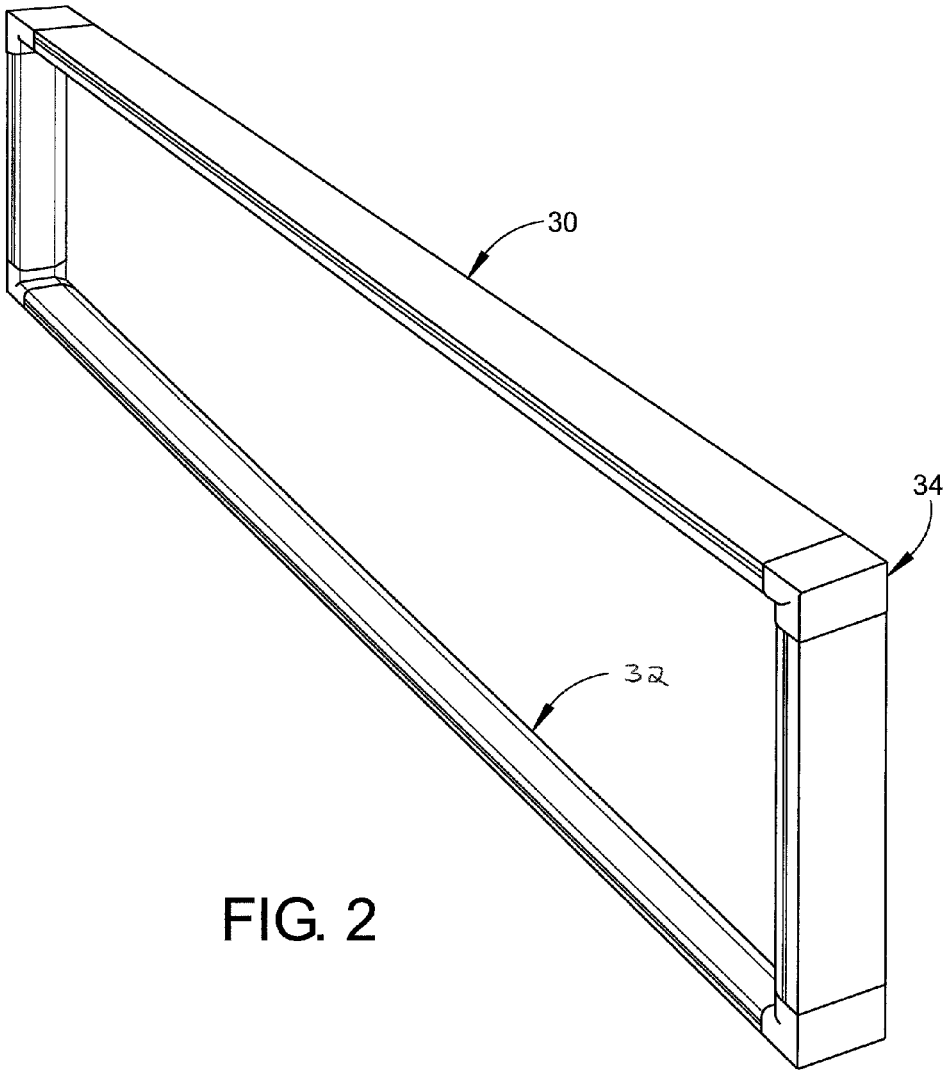
FIG. 2 is a perspective view of a portion of a mass airflow measuring system according to one embodiment of the present disclosure.

Positioned in the variable air volume terminal or in the inlet duct 22, or perhaps the air handling unit (not shown) is a mass airflow measuring system. With reference now to FIG. 2, in one embodiment, the mass airflow measuring system 30 can be rectangular in shape so that the system looks like a picture frame. The system can extend around the interior periphery of the air duct in which it is positioned or stationed so as to measure air flowing in the air duct past the assembly. It should be understood that all air flowing through the duct passes by the system 30. In this embodiment, the assembly can comprise four venturi sections or legs 32 and four corner sections or members 34. These are connected together and cooperate to define the picture frame type assembly. Of course, other designs are also conceivable. One advantage, however, of straight venturi legs, i.e., such that the section or leg extends along a straight linear axis, is that they can be extruded in a relatively straightforward manner from known materials, such as from a metal, for example aluminum, or from a suitable known thermoplastic material. Good tolerances can be maintained for the venturi legs during the extrusion process. Another benefit of extruding the venturi legs is that they can be cut to a desired custom length with less labor and equipment than the previously known construction methods for making the components of mass airflow sensor systems, and, hence, are less expensive to produce.

Figure 3:
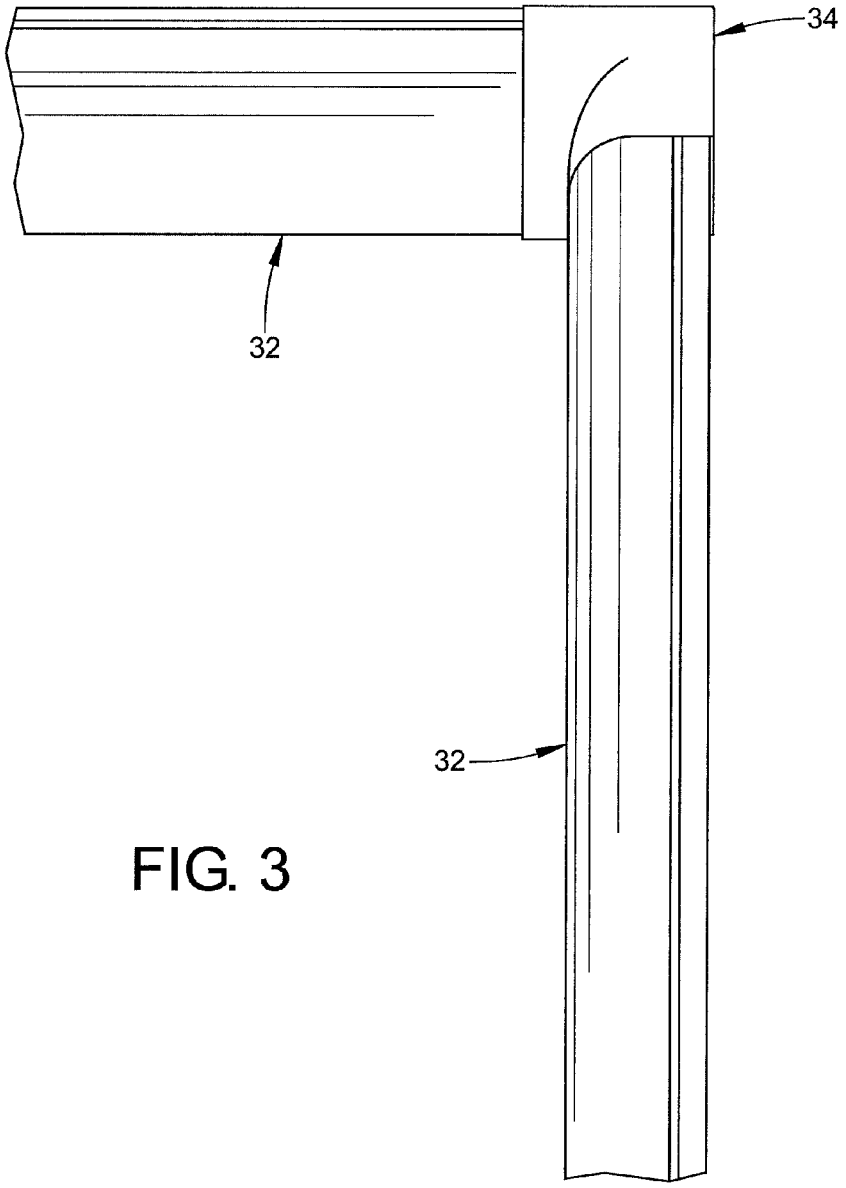
FIG. 3 is an enlarged perspective view of a section of the mass airflow measuring system of FIG. 2.

With reference now to FIG. 3, an enlarged corner section of the mass airflow measuring assembly is there illustrated. This figure more clearly shows the corner member 34 and the adjacent venturi legs 32 connected thereto. It should be appreciated that each venturi leg can be oriented generally perpendicular to the adjacent venturi leg section.

Figure 4:
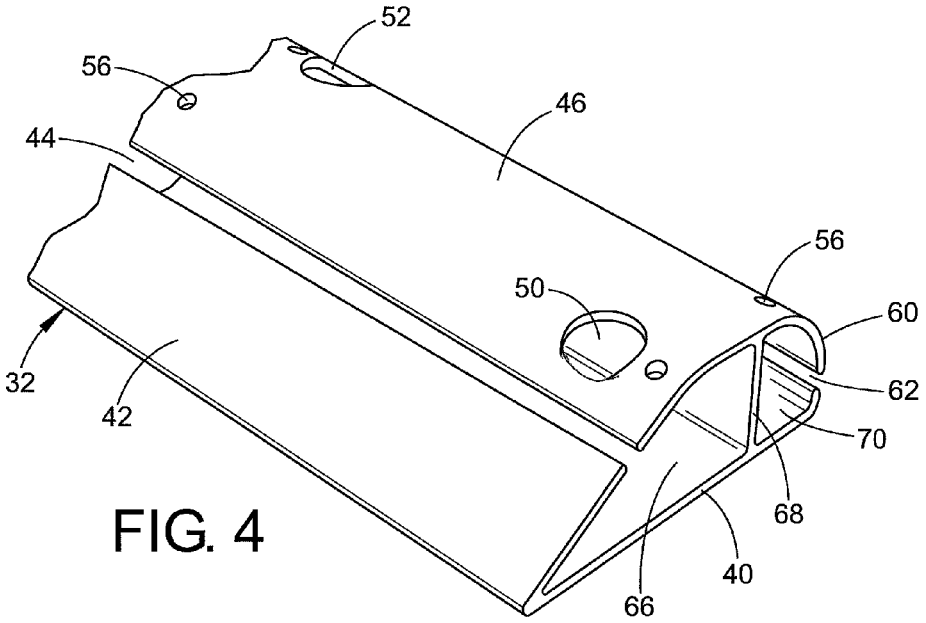
FIG. 4 is an enlarged perspective view of a portion of a venturi leg or section of the mass airflow measuring system of FIG. 2.

With reference now to FIG. 4, the venturi section or leg 32 can comprise a planar bottom wall 40, as well as a relatively planar angled rear wall 42. Defined in the rear wall is a second slot or outlet slot 44. Also provided is a relatively rounded top wall 46 in which there are defined a pair of spaced openings 50 and 52. These can be located near opposed ends of the top wall 46. The top wall leads to a curved front wall 60 in which there is defined a first slot or inlet slot 62. Put another way, in this embodiment, an asymmetric airfoil type shape is defined in cross-section. The bottom wall 40 is flat, whereas the top wall, including sections 42, 46 and 60, defines a leading edge at which the front of the airfoil has a maximum curvature and a minimum radius and a trailing edge which is relatively sharp.

Defined within the venturi leg 32 is a first or inlet air chamber 70 which is spaced by a dividing wall 68 from a second or outlet air chamber 66. It should be appreciated that the dividing wall 68 is positioned beneath the top wall 46 and connects the top wall to the bottom wall 40. It should be appreciated that the dividing wall 68 is located at the point of maximum thickness in cross-section of the airfoil shaped venturi section or leg 32. A chord line of the airfoil shaped venturi section or leg 32 lies along the bottom wall 40. The maximum thickness of the section or leg 32 is located at the dividing wall 68. The dividing wall can extend axially along the length of the section 32 from one side edge thereof to the opposite side edge thereof, as is illustrated in FIG. 4. Due to the extruded nature of the venturi leg 32, fairly accurate dimensional stability can be obtained for the sizes of the first and second slots 62 and 44, as well as for the sizes of the respective air chambers 70 and 66 which are defined in the venturi leg or section 32.

The extrusion process is advantageous in order to maintain and control the width of the first and second slots 62 and 44, as well as the sizes and volumes of the first and second air chambers 70 and 66, which can also be termed channels. Control of slot width allows one to equalize the area for input and exhaust flows in the venturi leg 32. It should be appreciated from FIG. 4 that the venturi leg allows the creation of airfoil flow patterns over the inner surface of the venturi leg, i.e., the curved front wall 60, the relatively flat top wall 46 and the angled and planar back wall 42. These allow for a smooth airflow in the air duct for air flowing past the several venturi legs 32 of the mass airflow measuring assembly 30.

Figure 5:
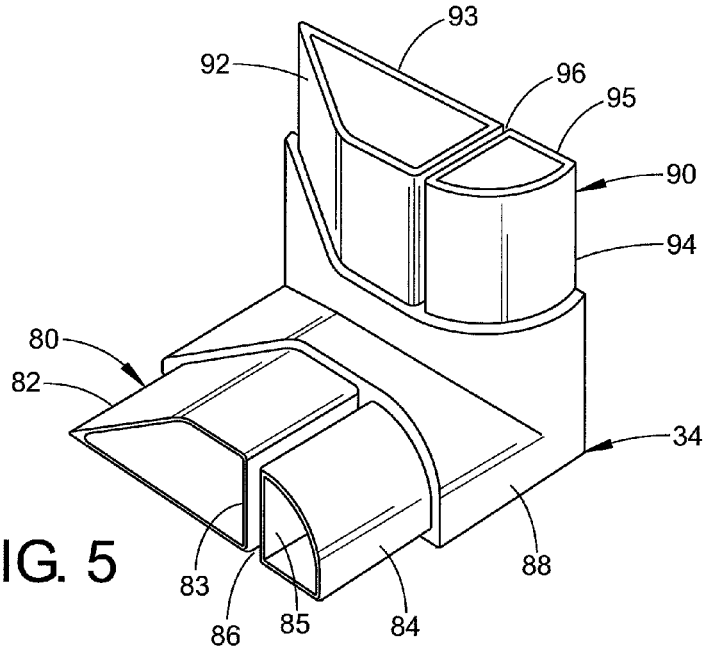
FIG. 5 is an enlarged perspective view of a corner member of the mass airflow measuring system of FIG. 2.

With reference now to FIG. 5, the corner member 34 used with the assembly comprises in one embodiment a first section 80 that includes a first leg 84, defined in which is a first channel 85, and spaced therefrom a second leg 82 defined in which is a second channel 83. It should be appreciated that the two legs 82 and 84 are spaced slightly apart by a slot 86. The legs 82 and 84 protrude from a base 88 and are aligned with each other. Extending from the base 88 is a direction generally normal or transverse to the direction of the first and second legs 84 and 82 is a second section 90 including a third leg 94, defined in which is a third channel 95, and a fourth leg 92, defined in which is a fourth channel 93. A slot 96 is located between the third and fourth legs 94 and 92.

In one embodiment, the corner member 34 can be die cast from a suitable metal such as aluminum or zinc. In another embodiment, the corner member 34 can be molded from a suitable known thermoplastic material, such as by injection molding. The corner member is designed with an airflow profile which matches the profiles of the venturi legs 32 and continues to the miter line of the corner. It should be apparent from a comparison of FIGS. 4 and 5 that a wall thickness of the venturi legs or sections 32 matches a height of a shoulder defined between the first and second legs 84 and 82 and the base 88. The same is true of the third and fourth legs 94 and 92 and the base. This promotes smooth airflow at the corners of the generally rectangular measuring system of this embodiment. In one embodiment, the corner member 34 provides a square 90 degree corner for assembly with the venturi legs 32. The corner member is advantageous for providing rigidity to limit the twist and distortion of the venturi legs or sections 32 during manufacture, transport and installation.

The legs of the corner member are designed to slip fit into the profile of the venturi legs so that when assembled, the corners and legs will create an assembly of square or rectangular configuration which is designed to fit the opening size in the air duct in which air flow is being measured. It should be appreciated that geometrical configurations other than square or rectangular are also contemplated. For example, a rhomboidal shape, a trapezoidal shape or the like can be employed instead of rectangular or square shapes or configurations if the air duct in which the sensor is mounted requires such a shape. Thus, the corner members or sections can have first and second legs which are oriented at angles other than exactly perpendicular to the third and fourth legs. In other words, acute and obtuse angular relationships between the first and second legs on the one hand, and third and fourth legs on the other hand of the corner member are also contemplated if so required by the cross-sectional shape of the air duct in which the measuring system is mounted.

In one embodiment, the corner member is affixed to the venturi leg with a fastener (not shown) that is located in a slot of the venturi member so that it can be factory or field assembled. The fastener is removable so that the length of the venturi leg can be shortened in order to accommodate field installation issues. The several legs 82, 84, 92, 94 of the corner member can be engaged in the first and second air chambers and the corners can be affixed to the respective venturi legs with fasteners that can be located in a slot of the venturi legs. The legs are long enough that the respective fastener can be loosened and the corner member moved somewhat away from its leg to slightly increase the overall size of the mass airflow measuring assembly 30.

It should be appreciated that the corner member has separate passages or channels 83 and 85 in a first section which do not communicate with each other, but do communicate with the corresponding passages or channels 93 and 95 defined in a second section of the corner member 34. A respective passage or channel 83, 85, 93, 95 communicates with a respective one of the first and second chambers 66 and 70 of the adjacent venturi leg 32.

In one embodiment, the corner member can be die cast, while in another embodiment, it can be injection molded. The corner member can be constructed from a variety of materials, including aluminum, zinc, or a variety of thermoplastics.

Figure 6:
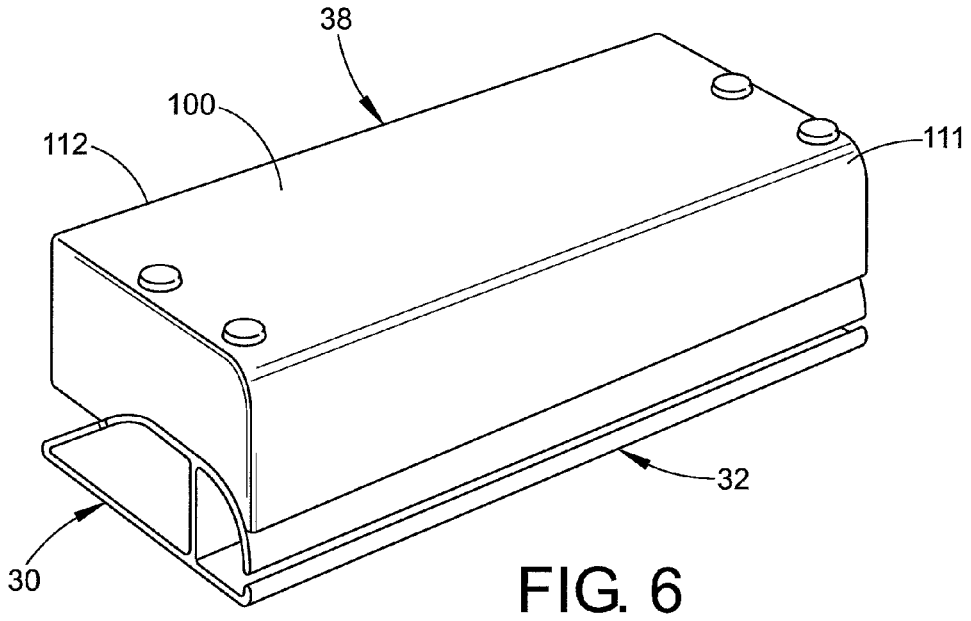
FIG. 6 is a perspective view of a portion of the mass airflow measuring system according to the present disclosure illustrating a sensor housing mounted to a venturi leg or section.
Figure 7:
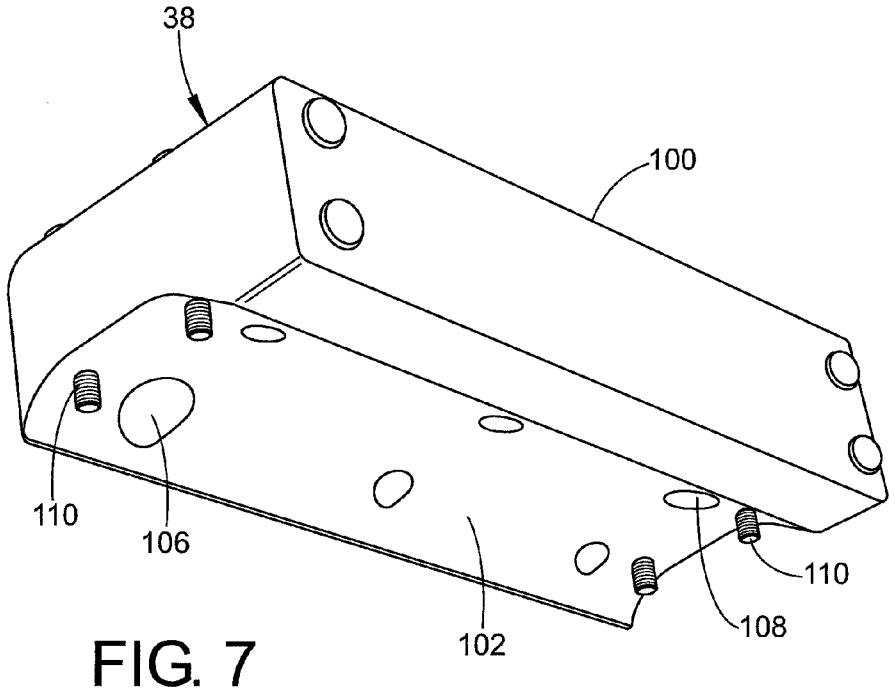
FIG. 7 is a bottom perspective view of the sensor housing of FIG. 6.

With reference now to FIG. 6, the sensor housing 38 is mounted to a portion of one of the venturi legs 32. In the illustrated embodiment, the sensor housing 38 is mounted to an inside wall of the picture frame assembly illustrated in FIG. 2 and more particularly to the curved top wall 46 of one venturi leg 32 of the mass airflow measuring assembly 30. The sensor housing includes a body 100 that is positioned over and mounted to the top wall 46 of the venturi leg 32 via suitable known fastening means. With reference now also to FIG. 7, the body 100 comprises a curved bottom wall 102 which matches the curvature of the top wall 46 of the venturi leg 32. Defined in the housing curved bottom wall 102 are spaced first and second openings 106 and 108. The first opening 106 in the body 100 communicates with the first opening 52 located in the top wall 46 of the venturi member 32 and the second opening 108 in the body communicates with the second opening 50 located in the top wall 46 of venturi member 32. Ideally, the diameters of the openings 50, 52, 106,108 are identical to promote smooth airflow.

In one embodiment, located on opposite ends of the body 100 and spaced from each other are feet 110. These are meant to be accommodated in the corresponding openings or apertures 56 defined in the top wall 46 of the venturi member 32. The feet 110 can be secured in the openings or apertures 56 in any conventional manner, so that the body 100 does not become detached from the venturi leg 32 in use.

It should be appreciated that the body 100 is affixed to one of the venturi sections or legs in such a way as to be positioned within the air duct as illustrated in FIG. 6. While air flowing past that portion of the airflow measuring system will encounter more resistance due to the presence of the body than will air flowing past the other sections of the sensor assembly, the airflow is somewhat smoothed out by the fact that a leading edge 111 of the body 100 is curved so as to promote a smooth airflow, whereas a trailing edge 112 thereof is sharp. It should also be appreciated that the body 100 can be redesigned so as to be more airfoil-shaped as are the various sections or venturi legs 32, thereby promoting smoother airflow in the air duct.

The assembly can be manufactured separately from the several sections 32 and corners 34. In this way, the assembly and the mass airflow sensor mounted thereto can be calibrated. Thus, the entire assembly does not need to be constructed and flow calibrated on site. Because the sensor modules are calibrated separately, the bodies 100 can be replaced without the need for removing and replacing the entire flow sensor assembly, including all of the sections or legs 32 and corners 34.

Figure 8:
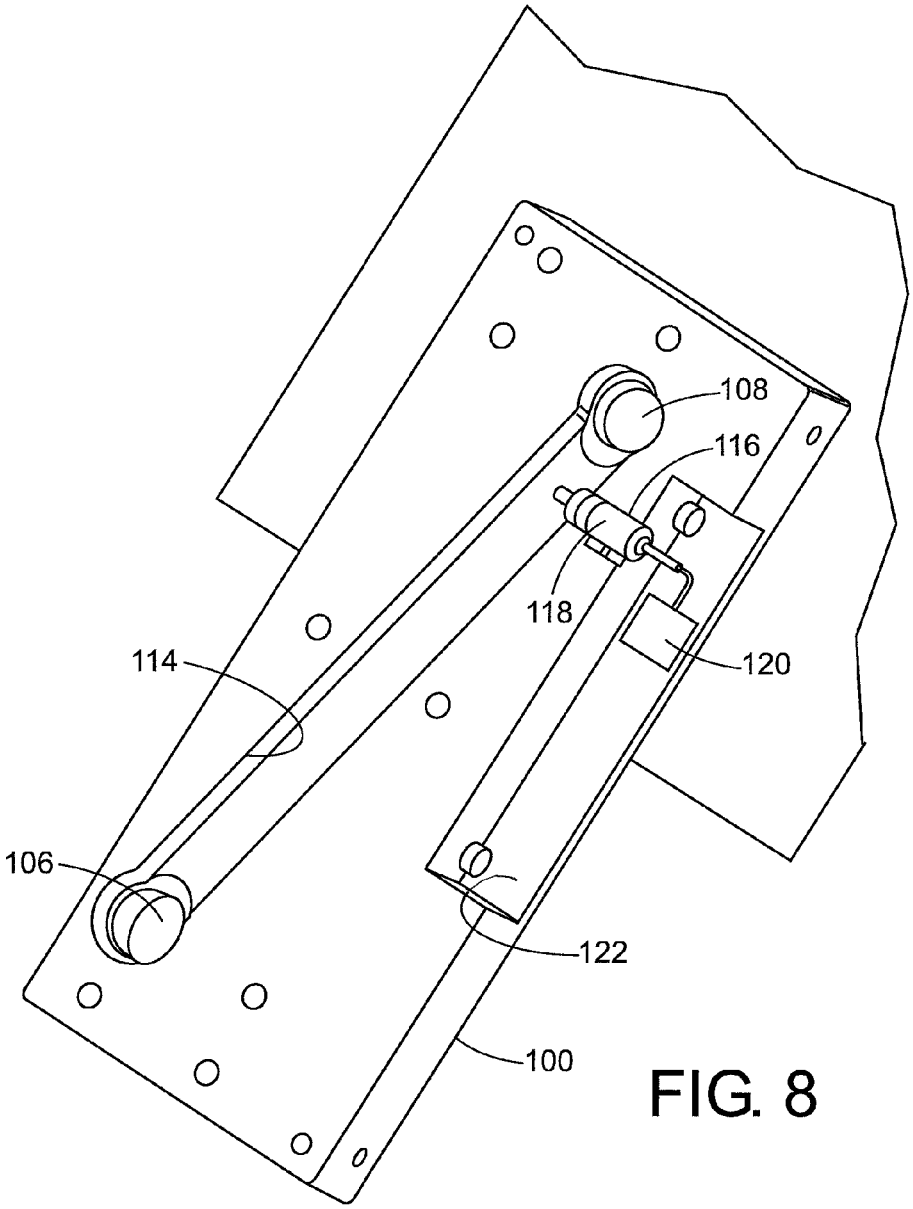
FIG. 8 is a schematic cross-sectional view through the sensor housing of FIG. 7.

With reference now to FIG. 8, the apertures 106 and 108 are connected to each other via a sampling channel 114 that is defined within the body 100. Communicating with the sampling channel 114 is a cross slot 116. Positioned or located in the cross slot is a known mass airflow sensor 118. In one embodiment, the sensor 118 can be a thin film resistor sensor which employs thin film resistance temperature detectors in a bridge arrangement to measure air mass flow rate with minimal disruption of the flow. One embodiment of such a known thin film mass airflow sensor is illustrated in U.S. Pat. No. 6,684,695, the disclosure of which is incorporated by reference hereinto in its entirety.

Numerous suppliers and types of such sensors 118 are available, as is known to those knowledgeable in the art. Such sensors are available from, e.g., IST USA, 9516 West Flamingo Road, Suite 210, Las Vegas, Nev. 89147. Another vendor for such system is Honeywell and its ZEPHYR™ sensors which are available from Sensing and Control Automation and Control Solutions, 1985 Douglas Drive, North Golden Valley, Minn. 55422. The sensors provide rapid response to the air or gas flow and amount and direction in delivering a proportional output voltage with high accuracy.

In one embodiment, the sensor 118 can comprise a hot wire and a monitor measuring device which senses airflow and converts the sensed airflow to a voltage signal. Also provided is a processor unit or processing device 120 which is operatively connected to the sensor 118. In one embodiment, the processing device 120 can be located in a recessed area 122 of the housing or body 100. Of course, other locations for the processing device 120 are also contemplated. The processing device 120 receives the voltage signal from the airflow sensor 118 and outputs a control signal which can be utilized by the control system of the HVAC assembly of the building. For example, the output signal from the processing unit 120 can be provided to a direct digital control system 128 (FIG. 1) associated with the building HVAC system in order to monitor and optimize the performance of the building's HVAC system.

A portion of the air flowing through the air duct will be drawn into the first chamber 70 via the inlet slot 62 and then flow via the sensor channel 114 past the sensor 118. The flow path of the air will then continue into the second chamber 66 and out through the second slot 44 back into the air duct. It should be appreciated that the first and second chambers 70 and 66 located in one venturi leg 32 of the picture frame-like mass airflow measuring assembly 30 communicate with the adjacent legs of the mass airflow measuring assembly via the corner members 34. More particularly, the first channel 70 of one venturi leg communicates with the first channel of an adjacent venturi leg via the first channel 85 in the first leg of the corner member and via the third channel 95 in the third leg 94 of that corner member with the first chamber in the adjacent venturi leg. Similarly, each of the first and second chambers 70 and 66 in each of the venturi legs communicates with the respective first and second chambers in the other venturi legs via the channels defined in the respective legs 84, 82, 94, 92 in each corner member 34. Thus, in this embodiment, rectangular picture frame-like inlet chambers 70 and outlet chambers 66 are defined. But, the inlet chambers 70 and outlet chambers 66 of the various venturi legs are separated from each other and no airflow is allowed between the two chambers, except through the sample channel 114 defined in the housing of the body 100 which is mounted to one of the legs of the picture frame-like mass airflow measuring assembly 30.

While a particular design of a body 100 has been illustrated herein, it should be appreciated that the body 100 may be constructed to have various sizes and shapes. Thus, other designs are possible for the body. For example, the side walls of the body illustrated in FIG. 7 could be made more curved, as could the top wall, in order to present a more aerodynamic appearance for the sensor housing 38.

It should be appreciated that the slots 44 and 62 can, in one embodiment, be continuous along an axial length of the venturi section or leg 32, as is illustrated in FIG. 4. Thus, the slots extend longitudinally from one side edge of the respective venturi leg 32 to the other side edge thereof. Only the dividing wall connects the bottom wall 40 to the upper section 42, 46, 60 of the venturi leg or section. One advantage of providing the longitudinally extending slots 44 and 62 employed in the venturi member 32 is that the slots allow a hook end of a known insulation strap (not shown) to grab and hold the venturi leg or member for ease of field installation of the measuring assembly in an air duct.

While a variety of shapes can be contemplated for the mass airflow measuring assembly 30, a measuring assembly having planar or straight legs or sections is advantageous from the perspective that such sections can be readily extruded. Moreover, because air ducts in cross section are generally rectangular or square having flat or planar wall sections, rectangular or square sections for the mass airflow measuring assembly 30 are advantageous in order to interfere as little as possible with air flowing through the air duct. Curved legs or sections would be more difficult to manufacture and, hence, more expensive to produce. With straight legs or sections, it is also easier to cut or manufacture the openings 50 and 52 located in the curved top wall 46 of the venturi leg 32 which is meant to accommodate the sensor body 100. Such holes or openings 50 and 52 can be manufactured or provided in the venturi leg 32 via punches or via laser cuts. With extruded venturi legs 32, hole location relative to the airfoil design of the interface of the venturi leg 32 can be accurately and repeatedly located in a precise manner allowing a very good process control for manufacturing the mass airflow measuring assemblies according to the present disclosure.

Figure 9:
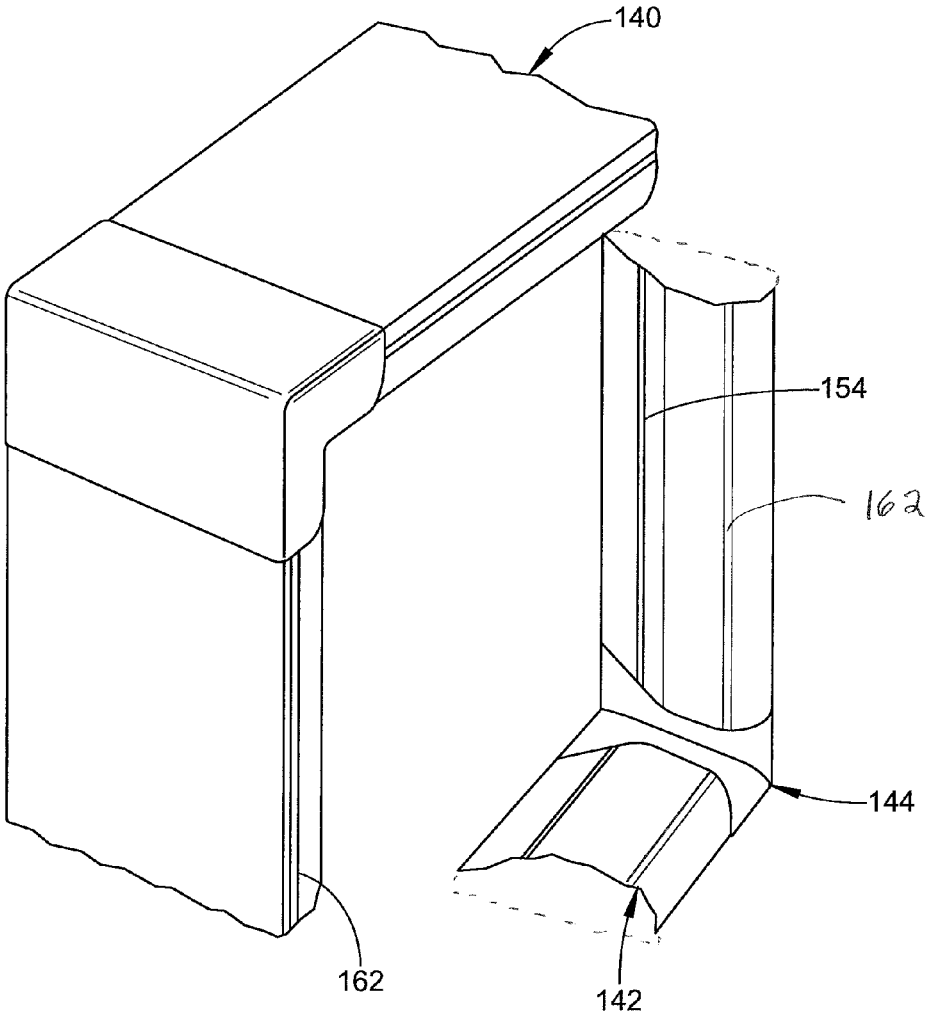
FIG. 9 is a perspective view of broken away portions of another embodiment of a mass airflow measuring system according to the present disclosure.

With reference now to FIG. 9, another embodiment of a mass airflow measuring system 140 according to the present disclosure comprises an airfoil shaped section and venturi member 142 and a corner section or member 144. Located in the venturi member 142 is an inlet slot 162, as well as an outlet slot 154, spaced from the inlet slot. In this embodiment, the mass airflow measuring system is generally square, as opposed to the rectangular nature of the system 30 illustrated in FIG. 2. As mentioned, a variety of shapes can be provided for the system as may be necessary for a particular air duct in which the system is meant to be accommodated. It should be appreciated that the planar rear walls of the system are meant to abut up against relatively flat adjacent wall of the air duct in which the sensor assembly is meant to be accommodated. In this way, the sensor assembly does not interfere unnecessarily with air flowing through the air duct.

In many applications, the central ducts in commercial HVAC settings for buildings are in the range of 24 inches by 12 inches in width and height respectively, thus providing a picture frame-type design or rectangular cross-section for the duct in question. Alternatively, however, the duct can have a relatively square design, such as 12 inches by 12 inches.

Several exemplary embodiments of the instant disclosure have been described herein. Obviously, modifications and alterations will occur to others upon a reading and understanding of the preceding detailed description. It is intended that the embodiments be construed as including all such modifications and alterations insofar as they come within the scope of the appended claims or the equivalents thereof.

The invention claimed is:

1. A mass airflow measuring system, comprising:

an air conduit;

a sensor assembly mounted to the air conduit, including:

a unitary one-piece first section which comprises in cross-section a first channel, a second channel, and a wall separating the first channel from the second channel, a unitary one-piece second section which comprises in cross-section a first channel, a second channel and a wall separating the first channel from the second channel, a unitary one-piece corner member which in cross-section comprises, first and second legs defined in which are respective first and second channels, that are spaced from one another, and third and fourth legs defined in which are respective first and second channels; and wherein the first leg first channel and second leg second channel communicate with respective ones of the first section first channel and second channel and the third leg first channel and the fourth leg second channel communicate with respective ones of the second section first channel and second channel, wherein the corner section first leg and third leg extend at one of an acute angle, a right angle and an obtuse angle in relation to each other;

a sensor housing mounted to one of the first and second sections, wherein the sensor housing includes an inlet opening communicating with the first channel of the one of the first and second sections and an exit opening communicating with the second channel of the one of the first and second sections, and a sample channel communicating the inlet opening with the exit opening; and a mass airflow sensor communicating with the sample channel to receive airflow, wherein the mass airflow sensor outputs a signal based on the airflow received by the mass airflow sensor.

2. The system of claim 1 wherein at least one of the first and second sections includes a first slot communicating with the first channel of the at least one of the first and second sections and a second slot communicating with the second channel of the at least one of the first and second sections.

3. The system of claim 1 wherein the sensor assembly is mounted to an interior wall of the air conduit.

4. The system of claim 1 wherein the sensor housing includes at least two spaced protrusions which cooperate with spaced indentations in the one of the first and second sections to mount the sensor housing to the one of the first and second sections.

5. The system of claim 1 wherein at least one of the first and second sections is airfoil-shaped in cross-section including a rounded first portion and a tapered planar second portion.

6. The system of claim 5 wherein a first slot is located in the first section and communicates with the first channel of the at least one of the first and second sections and a second slot is located in the first section and communicates with the second channel thereof.

7. The system of claim 6 wherein at least one of the first and second slots extends across an entire length of the at least one of the first and second sections.

8. The system of claim 1 wherein the corner section comprises a thermoplastic material.

9. The system of claim 1 wherein at least one of the first and second sections comprises an extrusion.

10. A mass airflow measuring system comprising:

a rectangular air conduit;

a sensor assembly mounted to the air conduit, the sensor assembly including:

a one-piece first section which comprises in cross-section a first channel a second channel and a wall separating the first channel from the second channel, a one-piece second section which comprises in cross-section a first channel, a second channel and a wall separating the first channel from the second channel, a one-piece corner section which includes a first leg defining a first channel portion, the first leg being adapted to slide into the first section first channel and, spaced therefrom, a second leg defining a second channel portion, the second leg being adapted to slide into the first section second channel, a third leg defining a first channel portion, the third leg being adapted to slide into the second section first channel and, spaced therefrom, a fourth leg defining a second channel portion, the fourth leg being adapted to slide into the second section second channel, wherein the first and second legs protrude from a base of the corner section, a sensor housing mounted to one of the first and second sections, wherein the sensor housing includes an inlet opening communicating with the first channel of the one of the first and second sections, an exit opening communicating with the second channel of the one of the first and second sections, and a sample channel communicating the inlet opening with the exit opening; and a mass airflow sensor held in the sensor housing so as to receive airflow from the sample channel.

11. The system of claim 10 wherein the first section extends along a linear axis from a first end thereof to a second end thereof.

12. The system of claim 11 wherein the second section extends along a linear axis from a first end thereof to a second end thereof.

13. The system of claim 12 wherein the corner section first leg is oriented at about a right angle to the corner section third leg.

14. The system of claim 10 wherein at least one of the first and second sections includes a first slot communicating with the first channel of the at least one of the first and second sections and a second slot communicating with the second channel of the at least one of the first and second sections.

15. The system of claim 10 wherein the sensor assembly is mounted to an interior wall of the air conduit.

16. The system of claim 10 wherein the sensor housing includes at least two spaced protrusions which cooperate with spaced indentations in the one of the first and second sections to mount the sensor housing to the one of the first and second sections.

17. A mass airflow measuring system comprising:

a rectangular air conduit;

a rectangular sensor assembly mounted to an interior wall of the air conduit, the assembly including:

first, second, third and fourth sections each including a planar rear wall and an airfoil-shaped front wall and each defining a first channel, a second channel and a wall separating the first channel from the second channel, first, second, third and fourth corner sections each including a first leg defining a first channel and, spaced therefrom, a second leg defining a second channel, and a third leg defining a first channel and, spaced therefrom, a fourth leg defining a second channel, wherein the first channels of the first, second, third and fourth sections communicate with each other via the first channels of the first, second, third and fourth corner sections, wherein the second channels of the first, second, third and fourth sections communicate with each other via the second channels of the first, second, third and fourth corner sections;

a sensor housing mounted to one of the first, second, third and fourth sections, wherein the sensor housing includes an inlet opening communicating with the first channel of the one of the first, second, third and fourth sections, an outlet opening communicating with the second channel of the one of the first, second, third and fourth sections, and a sample channel communicating the sensor housing inlet opening with the sensor housing exit opening; and a mass airflow sensor held in the sensor housing so as to receive airflow from the sample channel.

18. The system of claim 17 wherein the corner section first leg is oriented at about a right angle to the third leg of the corner section.

19. The system of claim 17 wherein a first slot is located in at least one of the first, second, third and fourth sections, the first slot communicating with the first channel of the at least one of the first, second, third and fourth channels.

20. The system of claim 19 wherein a second slot is located in at least one of the first, second, third and fourth sections, the second slot communicating with the second channel of the at least one of the first, second, third and fourth sections.

21. The system of claim 20 wherein at least one of the first and second slots extends across an entire length of the at least one of the first and second sections.

* * * * *